US009963904B1

(12) United States Patent
Garcia

(10) Patent No.: US 9,963,904 B1
(45) Date of Patent: May 8, 2018

(54) PRIVACY STRIPS/ PRIVACY TIPS

(71) Applicant: Darin Michael Garcia, Poway, CA (US)

(72) Inventor: Darin Michael Garcia, Poway, CA (US)

( * ) Notice: Subject to any disclaimer, the term of this patent is extended or adjusted under 35 U.S.C. 154(b) by 0 days. days.

(21) Appl. No.: 15/344,523

(22) Filed: Nov. 6, 2016

(51) Int. Cl.
*G01D 21/00* (2006.01)
*E04H 17/14* (2006.01)

(52) U.S. Cl.
CPC ..... *E04H 17/1426* (2013.01)

(58) Field of Classification Search
CPC ..... E04H 17/1426
USPC ..... 428/81
See application file for complete search history.

(56) References Cited

U.S. PATENT DOCUMENTS 2,098,777 A * 11/1937 Elmendorf ..... E04F 15/04 52/802.1
4,756,511 A * 7/1988 Wright, III ..... E01F 7/02 256/12.5
2016/0244992 A1* 8/2016 Presti ..... E04H 17/1421

* cited by examiner

*Primary Examiner* — Brent T O'Hern

(57) ABSTRACT

An apparatus to fill vertical gaps between pickets. The apparatus comprising a privacy strip and a privacy tip. The privacy strip configured to occupy the vertical gaps found between at least two parallel and vertical pickets between the top stringer and the bottom stringer. The privacy tip configured to occupy the vertical gaps created above the top stringer and between at least two parallel and vertical pickets. The privacy strip is integrated into the privacy fence by inserting a first side of the privacy strip into the top of the bottom stringer, bending out, and then inserting the second side of the privacy strip into the bottom of the top stringer. The privacy tip is integrated into the privacy fence by sticking a first wedge side into the top stringer.

3 Claims, 1 Drawing Sheet

PRIVACY STRIPS/ PRIVACY TIPS

CROSS REFERENCE TO RELATED APPLICATIONS

Not Applicable.

FIELD OF INVENTION

This invention relates to general to privacy fences, and more particularly to an apparatus designed to fill open gaps between pickets in privacy fencing arrangements.

BACKGROUND

Privacy fences made of wood shrink throughout the years and create a vertical gap in between the fence boards that allow neighbors to peek through, therefore, losing your privacy. Other products such as bamboo sections have been used to try and cover large sections of fence, but rot out after a couple of years, fall apart and have to constantly be replaced.

SUMMARY

My invention works by inserting individual privacy strips in between the vertical gap of the fence boards. Insert into the top of the bottom 2×4 that runs horizontal to the fence boards and then bend out and insert into the bottom of the top 2×4 that also runs horizontal to the fence boards. For privacy tips, simply insert a shorter strip into the top 2×4 to cover the short gap above the top 2×4. Product can be plastic, wood, vinyl, aluminum, metal, etc.

BRIEF DESCRIPTION OF DRAWINGS

FIG. 1*b* illustrates an exploded view of the Privacy Tip shown in FIG. 1*a*.

FIG. 1*c* illustrates an exploded view of the Privacy Strip shown in FIG. 1*a*.

DETAILED DESCRIPTION AND BEST MODE OF IMPLEMENTATION

Figure 1A:
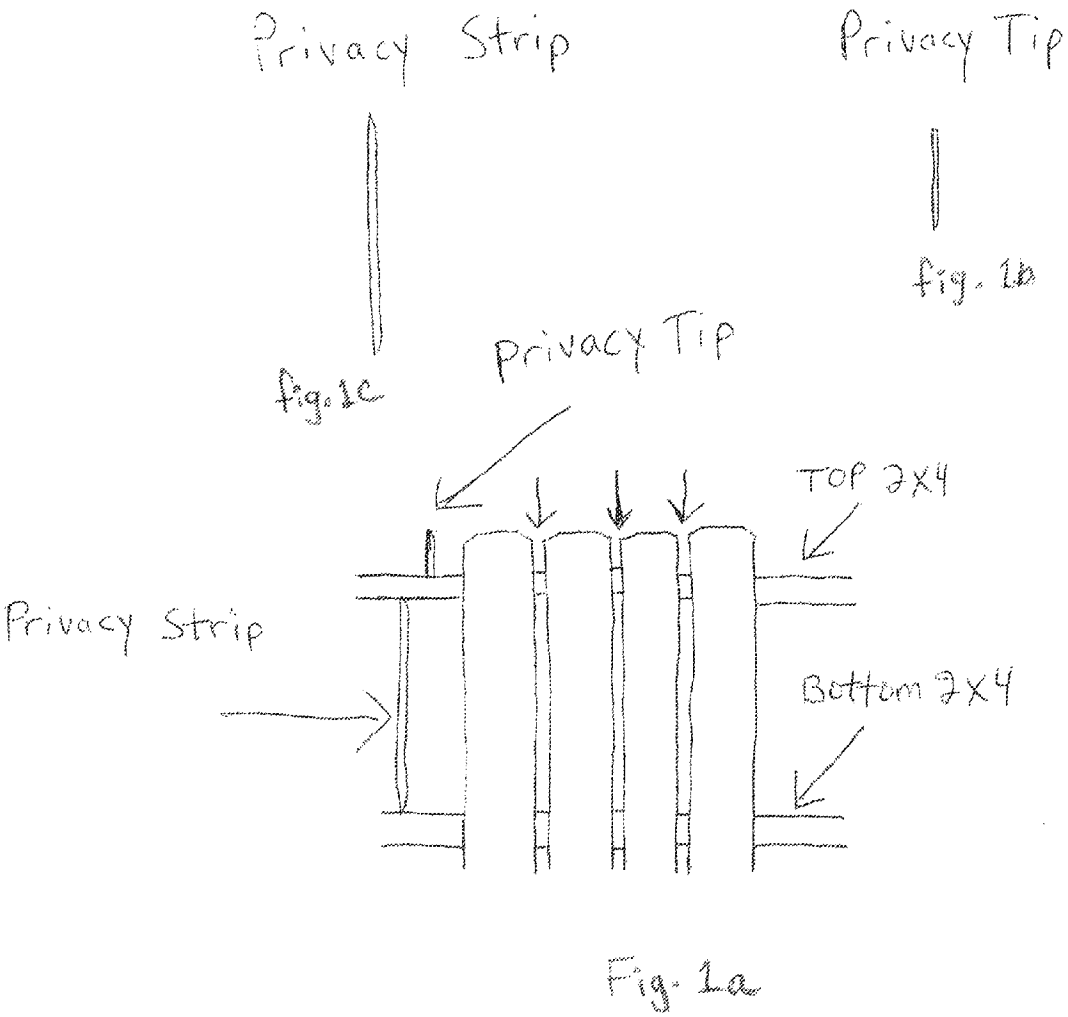
FIG. 1*a* illustrates an exemplary privacy fencing design showing where a privacy tip and privacy strip would be placed.

My invention works by inserting individual privacy strips in between the vertical gap of the fence boards. Insert into the top of the bottom 2×4 that runs horizontal to the fence boards and then insert into the bottom of the top 2×4 that also runs horizontal to the fence boards. For privacy tips, simply insert a shorter strip into the top 2×4 to cover the short gap above the top 2×4 so taller people can't see into your back yard. Product can be plastic, wood, vinyl, or any material that would allow for the successful covering of the individual vertical gaps/spaces in between the fence boards. The features and parts simply consist of individual strips and the top and bottom of these strips may be wedged or non-wedged.

Referring now to FIG. 1*a*. FIG. 1*a* illustrates an exemplary privacy fencing design showing where a privacy tip and privacy strip would be placed. By inserting individual privacy strips in between the vertical gap of the fence boards. Insert into the top of the bottom 2×4 that runs horizontal to the fence boards and then insert into the bottom of the top 2×4 that also runs horizontal to the fence boards.

For privacy tips, simply insert a shorter strip into the top 2×4 to cover the short gap above the top 2×4 so taller people can't see into your back yard. The privacy strip and the privacy tip are intended to fill vertical gaps between pickets.

As illustrated in FIG. 1A, a privacy strip, privacy tip, and a privacy fence, comprising:

a privacy strip made of plastic and is one inch wide;

a privacy tip made of plastic and is one feet long;

a privacy fence having a first picket, a second picket, a bottom stringer, and a top stringer;

wherein the privacy strip is in a vertical gap between a right side of the first picket and a left side of the second picket and above the bottom stringer and below the top stringer wherein a bottom of the privacy strip is inserted into a top surface of the top stringer and between the right side of the first picket and the left side of the second picket.

The privacy strip is configured to occupy only the volume of space created between a right side of a first picket, a left side of a second picket, above a bottom stringer of a privacy fence and below a top stringer of the privacy fence. The privacy strip is integrated into the privacy fence by inserting a first side of the privacy strip into the top of the bottom stringer, bending out, and then inserting the second side of the privacy strip into the bottom of the top stringer. The privacy strip may be made of vinyl, plastic, wood, aluminum, steel, or tin. The privacy strip may be one inch wide.

The privacy tip configured to occupy the volume of space created above the top stringer, and between the right side of the first picket and the left side of the second picket. The privacy tip may be one feet long. The privacy tip is integrated into the privacy fence by sticking a first wedge side into the top stringer. The privacy tip is made of vinyl, plastic, wood, aluminum, steal, or tin.

Referring now to FIG. 1*b*. FIG. 1*b* illustrates an exploded view of the privacy tip shown in FIG. 1*a*. The privacy tip may be one feet long.

Referring now to FIG. 1*c*. FIG. 1*c* illustrates an exploded view of the privacy strip shown in FIG. 1*a*. The privacy strip may be one inch wide.

Simply insert an approximate 1 inch wide strip into the top of lower 2×4 that runs horizontal to the fence boards and insert it into the bottom of the top 2×4 that also runs horizontal to the fence boards. For privacy tips, which are approx. 1 foot long, simply stick one wedged side into the top of the top 2×4 that runs horizontal to the fence boards to unsure that taller people can't see into your back yard.

My individual privacy strips will keep neighbors and other people from being able to look into your back yard. Privacy Tips will keep taller people from being able to look into your back yard. Making your entire back yard 100% private. Material can consist of plastic, wood, vinyl, metal, aluminum, steel, tin, etc.

The invention claimed is:

1. A combination of privacy strip, privacy tip, and a privacy fence, comprising:

a privacy strip made of plastic and is one inch wide;

a privacy tip made of plastic and is one feet long;

a privacy fence having a first picket, a second picket, a bottom stringer, and a top stringer;

wherein the privacy strip is in a vertical gap between a right side of the first picket and a left side of the second picket and above the bottom stringer and below the top stringer;

wherein a bottom of the privacy tip is inserted into a top surface of the top stringer and between the right side of the first picket and the left side of the second picket.

2. A combination of privacy strip, privacy tip, and a privacy fence, comprising:

a privacy strip made of wood and is one inch wide;

a privacy tip made of wood and is one feet long;

a privacy fence having a first picket, a second picket, a bottom stringer, and a top stringer;

wherein the privacy strip is in a vertical gap between a right side of the first picket and a left side of the second picket and above the bottom stringer and below the top stringer;

wherein a bottom of the privacy tip is inserted into a top surface of the top stringer and between the right side of the first picket and the left side of the second picket.

3. A combination of privacy strip, privacy tip, and a privacy fence, comprising:

a privacy strip made of metal and is one inch wide;

a privacy tip made of metal and is one feet long;

a privacy fence having a first picket, a second picket, a bottom stringer, and a top stringer;

wherein the privacy strip is in a vertical gap between a right side of the first picket and a left side of the second picket and above the bottom stringer and below the top stringer;

wherein a bottom of the privacy tip is inserted into a top surface of the top stringer and between the right side of the first picket and the left side of the second picket.

* * * * *